US005976645A

United States Patent [19]

Daluise et al.

[11] Patent Number: 5,976,645

[45] Date of Patent: Nov. 2, 1999

[54] VERTICALLY DRAINING, RUBBER-FILLED SYNTHETIC TURF AND METHOD OF MANUFACTURE

[75] Inventors: Daniel A. Daluise, Southboro, Mass.; Paul R. Lioi, Canton, Ohio

[73] Assignee: Safturf International Limited, Canton, Ohio

[21] Appl. No.: 09/088,797

[22] Filed: Jun. 1, 1998

[51] Int. Cl.[6] ..... A41G 1/00

[52] U.S. Cl. ..... 428/17; 273/DIG. 13

[58] Field of Search ..... 428/17; 273/DIG. 13

[56] References Cited

U.S. PATENT DOCUMENTS

| | | | |
|---|---|---|---|
| 3,157,557 | 11/1964 | Palmer | 161/19 |
| 3,332,828 | 7/1967 | Faria et al. | 161/21 |
| 3,570,846 | 3/1971 | Weber et al. | 272/56.5 |
| 3,661,687 | 5/1972 | Spinney, Jr. et al. | 161/21 |
| 3,731,923 | 5/1973 | Greene | 272/56.5 |
| 3,740,303 | 6/1973 | Alderson et al. | 161/67 |
| 3,801,421 | 4/1974 | Allen et al. | 161/67 |
| 3,900,656 | 8/1975 | Schmidt | 428/215 |
| 3,995,079 | 11/1976 | Haas, Jr. | 428/17 |
| 4,044,174 | 8/1977 | Carr | 427/130 |
| 4,044,179 | 8/1977 | Haas, Jr. | 428/17 |
| 4,337,283 | 6/1982 | Haas, Jr. | 428/17 |
| 4,497,853 | 2/1985 | Tomarin | 428/17 |
| 5,601,886 | 2/1997 | Ishikawa et al. | 428/17 |
| 5,605,721 | 2/1997 | Di Geronimo | 427/373 |

FOREIGN PATENT DOCUMENTS

| | | |
|---|---|---|
| 560 067 | 9/1923 | France . |
| 74 25339 | 2/1975 | France . |
| 401304 | 11/1933 | United Kingdom . |
| 1 411 623 | 10/1975 | United Kingdom . |

*Primary Examiner*—Alexander Thomas
*Attorney, Agent, or Firm*—Nields, Lemack & Dingman

[57] ABSTRACT

Vertically draining synthetic turf having reduced abrasiveness and increased resilience compared to conventional synthetic turfs. The vertical draining system of the present invention prevents water from accumulating on the turf surface, which could cause the top-dressing layer to "float" and be moved by inundation. The draining system of the present invention incorporates a porous geotextile membrane between an open graded aggregate layer and a sand layer above the aggregate layer to prevent the movement of one aggregate layer into the other. The top-dressing layer consists of resilient particles, preferably a mixture of high and low density rubber. The pile fabric preferably includes an isotropic non-woven backing to add dimensional stability.

23 Claims, 2 Drawing Sheets

VERTICALLY DRAINING, RUBBER-FILLED SYNTHETIC TURF AND METHOD OF MANUFACTURE

BACKGROUND OF THE INVENTION

Artificial turf has long been used in athletic venues. It is a general object of such surfaces to mimic natural grass turfs while eliminating the high maintenance required and poor durability of the same. However, much concern has arisen about the propensity for certain types of injury associated with the product. Indeed, grass surfaces provide excellent shock-absorbing properties and excellent traction for athletes as they traverse the turf, yet conventional synthetic turfs tend to fall short in these areas. Moreover, conventional synthetic turfs tend to be abrasive, rendering them inappropriate for such sports as soccer and lacrosse. In addition, unnatural ball action on conventional turfs inhibits play of these and other sports.

More recently, artificial turf filled with a mixture of sand and rubber has been shown to address many of these problems by reducing the potential for certain turf-induced injuries and by greatly reducing abrasion. For example, U.S. Pat. No. 4,337,283 discloses an artificial turf comprising a subsurface, a pile fabric having a flexible backing on the subsurface, and a compacted top-dressing layer comprising a mixture of from 25 to 95 volume percent resilient particles such as rubber, and from 5 to 75 volume percent fine sand. The top-dressing layer is interspersed among the pile elements of the pile fabric and on the backing. The purpose of the top-dressing layer is to stabilize the pile elements, prevent graininess (i.e., prevent the tendency of the pile fabric to lay in a given direction), absorb shock, and improve the footing of a player running or walking across the surface. Although the use of fine sand in the top-dressing layer adds weight and reduces sponginess to the pile fabric layer and is less abrasive than "large" sand, it still suffers from undesirable abrasiveness. In addition, the turf system relies on gravity and the slope of the sub-base for water drainage.

SUMMARY OF THE INVENTION

The problems of the prior art have been overcome by the present invention, which provides a vertically draining synthetic turf having reduced abrasiveness and increased resilience compared to conventional synthetic turfs. The vertical draining system of the present invention prevents water from accumulating on the turf surface, which could cause the top-dressing layer to "float" and be moved by inundation. The draining system of the present invention incorporates a porous geotextile membrane between an open graded aggregate layer and a sand layer above the aggregate layer to prevent the movement of one aggregate layer into the other.

The top-dressing layer of the present invention eliminates the use of sand and its concomitant abrasiveness. The top-dressing layer consists of resilient particles, preferably a mixture of high and low density rubber.

The pile fabric preferably includes a spun-bound, non-woven, isotropic backing which is laminated or otherwise secured to a woven (FLW) backing which is tufted with the felt side facing the ground and toward the non-woven backing.

DETAILED DESCRIPTION OF THE INVENTION

Figure 1:
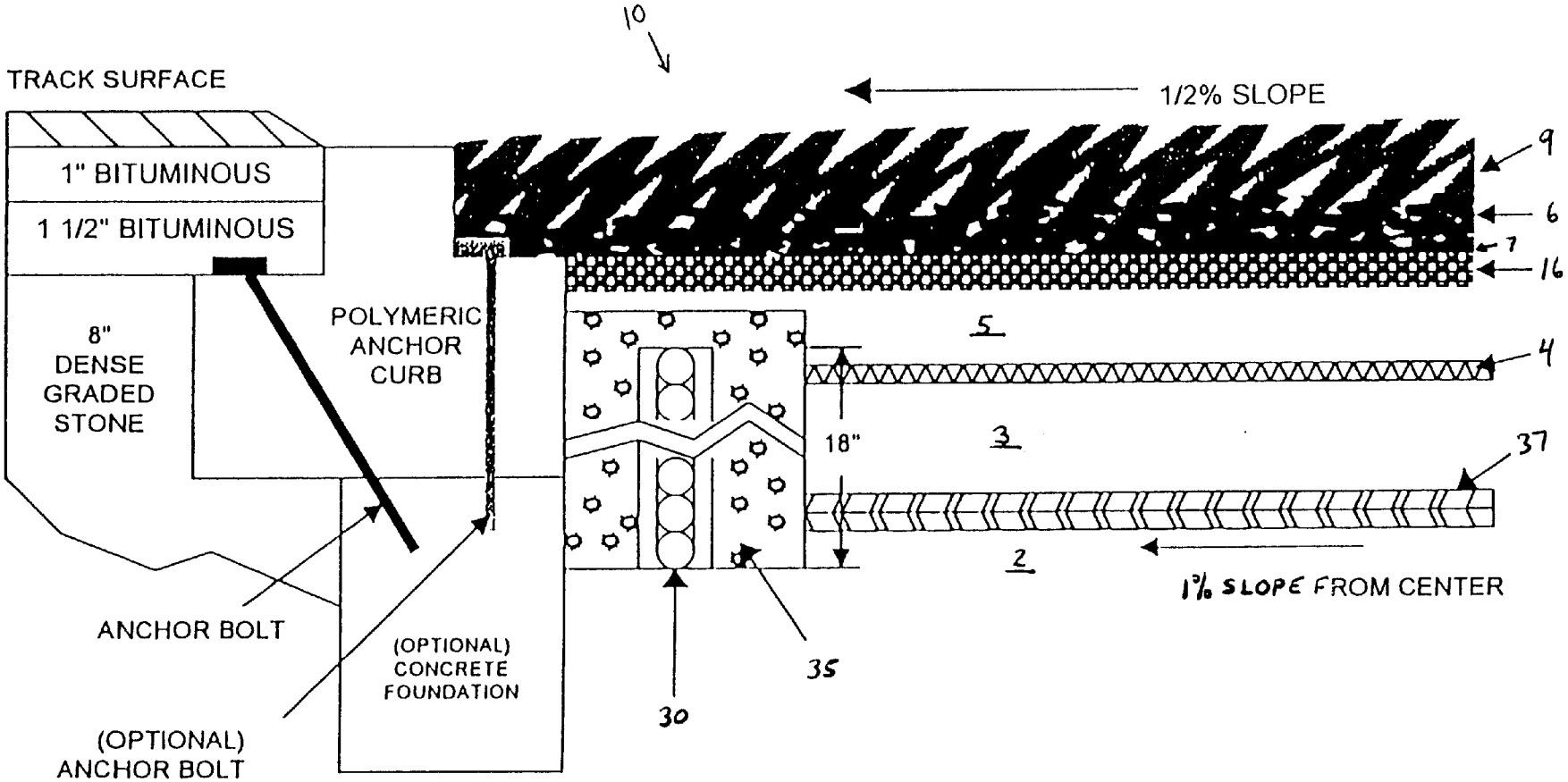
FIG. 1 is a cross-sectional view of the artificial turf in accordance with the present invention.

Turning first to FIG. 1, there is shown generally at 10 a synthetic turf having a sloped sub-surface base 2 layer. The sub-surface base 2 is formed by removing turf, loam, etc. and grading and compacting the earth. Excavation of materials is as necessary to establish a proper grade of sub-base to a tolerance of about 1" per 10 feet. Preferably the slope of the sub-surface base 2 is 0.5% to about 1% from the field centerline in order to facilitate drainage, and the sub-base is compacted to about 95% Proctor density, if possible, to form a firm and stable surface.

An open graded aggregate layer 3 is disposed over the sub-surface base 2. Preferably the open aggregate layer 3 is comprised of free-draining stone, and the layer has a thickness of about 6 inches. Suitable open graded aggregate is a mixture of sand and stone, and has low fines, preferably under 5% fines of 200 mesh size. One particular suitable aggregate has the following analysis:

| % of Passing | Sieve size |
|---|---|
| 100 | 1.25" |
| 52–100 | ¾" |
| 36–65 | ⅜" |
| 8–40 | #4 |
| 0–12 | #16 |
| 0–5 | #200 |

Preferably the aggregate is installed so as to maintain a finished grade slope of 0.5% or greater toward the edges of the field.

Situated over the entire open graded aggregate layer 3 is a non-woven porous geotextile membrane 4, preferably made of a needle punched polypropylene, such as Amoco 4545 commercially available from Amoco. The membrane 4 is permeable to water but prevents movement of one aggregate layer into the other. Specifically, a porous free-draining layer of sand 5, preferably about 2 inches thick, is placed over the membrane 4, and the membrane 4 functions to prevent the sand layer 5 from intermingling with the aggregate layer 3 below. In the absence of the membrane layer 4, water tends to carry sand from the sand layer 5 into the interstices of the open aggregate layer 3, reducing the porosity of the open aggregate layer, thereby reducing the critical drainage efficiency of the same. In addition, as the sand is carried into the open graded aggregate layer 3, the sand layer develops deleterious depressions (cupping) where the flow of water is concentrated. Preferably the membrane 4 is about ⅛ inches thick.

In order to minimize or eliminate the tendency of the sand layer 5 to compact, resilient particles or granules 16 such as rubber particles are embedded, mixed or otherwise added to the sand layer 5. Specifically, after the sand layer has been compacted and fine-graded, resilient particles 16 such as rubber granules are applied at a uniform rate to the entire sand layer, such as by drop spreading, spraying, or other pneumatic delivery method. Preferably the amount of rubber granules used is from about 0.2 to about 3 lb/ft$^2$, most preferably about 1 lb/ft$^2$. After application, the resilient particles are preferably forced into the sand layer 5 and become embedded therein with a standard compaction roller. The embedded particles helps prevent sand compaction by maintaining particle separation. By preventing compaction, the embedded resilient particles ensure that the sand layer remains open and porous, maintaining drainage efficiency. The embedded resilient particles also enhance the overall shock absorption of the entire system (without a concomitant increase in pile height or infill depth) and prevent a decrease in shock absorption capabilities of the entire system over time. Suitable resilient particles for this purpose include natural rubber, synthetic rubber such as styrene butadiene (ground tire rubber), butyl rubber, neoprene, urethane rubber, nitrile rubber, etc.

The playing surface 1 includes a pile fabric 9 of individual tufted yarn or yarn-like filaments. The material used for the yarn filaments is not particularly limited, and can include polypropylene or polyethylene, or preferably a polyethylene/polypropylene blend yarn, or other suitable yarn material. A blend of 80% polyethylene and 20% polypropylene yarn is preferred due to its low abrasiveness and its grass-like appearance. Tufting through the backing at a yarn density of about 10 to 60 oz/yd$^2$, preferably about 20–30 oz/yd$^2$, so that the yarn is upstanding and substantially uniform in height, can be carried out to provide a higher weight playing surface.

The fabric backing layer 7 is preferably a heavy weight polymeric coated backing to provide additional weight and stability. The backing preferably incorporates a polyester/nylon blend, spun-bound, non-woven material which provides exceptional dimensional stability, thus preventing wrinkling. This non-woven backing is preferably bonded to the standard woven backing, known in the art as "FLW", which includes a layer of felt. Conventionally, the felt layer is positioned so that it faces upward. However, in accordance with a preferred embodiment of the present invention, the felt layer is oriented toward the ground, thereby facing downward toward the non-woven backing layer. The spun-bonded non-woven backing is made of absorbent polymers such as nylon and polyester which absorb the liquid-applied secondary backing, such as a urethane or styrene butadiene typically used in a carpet coating process. The liquid-applied secondary backing can be applied by spray coating, and helps bond the yarn tufts and add strength and stiffness to the carpet. The non-woven material also has the advantage of being very open in its physical construction. This feature, combined with the highly absorbent nature of the felt side of the FLW primary backing, creates a double backing which can absorb much higher weights of carpet coating polymers. As a result, the product has sufficient weight and dimensional stability to preclude the possibility of wrinkling or other movement due to thermal expansion and contraction or impact loading.

The entire double backing is preferably perforated with holes 2" to 8" apart to allow for vertical drainage, with 4" average separation being especially preferred. Suitable hole diameters include diameters ranging from about 0.1" to about 0.75", with 0.25"–0.5" being preferred. The hole size can vary from hole to hole.

The top-coating or infill layer 6 is devoid of sand and its concomitant abrasiveness. It is composed entirely of resilient material, preferably rubber, including natural rubber, synthetic rubber such as styrene butadiene (ground tire rubber), butyl rubber, neoprene, urethane rubber, nitrile rubber, etc. Preferably a blend of ground tire rubber and high density rubber is used, with the preferred amount of high density rubber being about 75–80% of the mix. The depth of the infill should be substantially uniform and between about 0.5 inches and 1.75 inches, and is preferably about 1.5 inches in the case where the pile height is 2". Typically the infill should be between ¾" and ½" below the full pile height.

Figure 2:
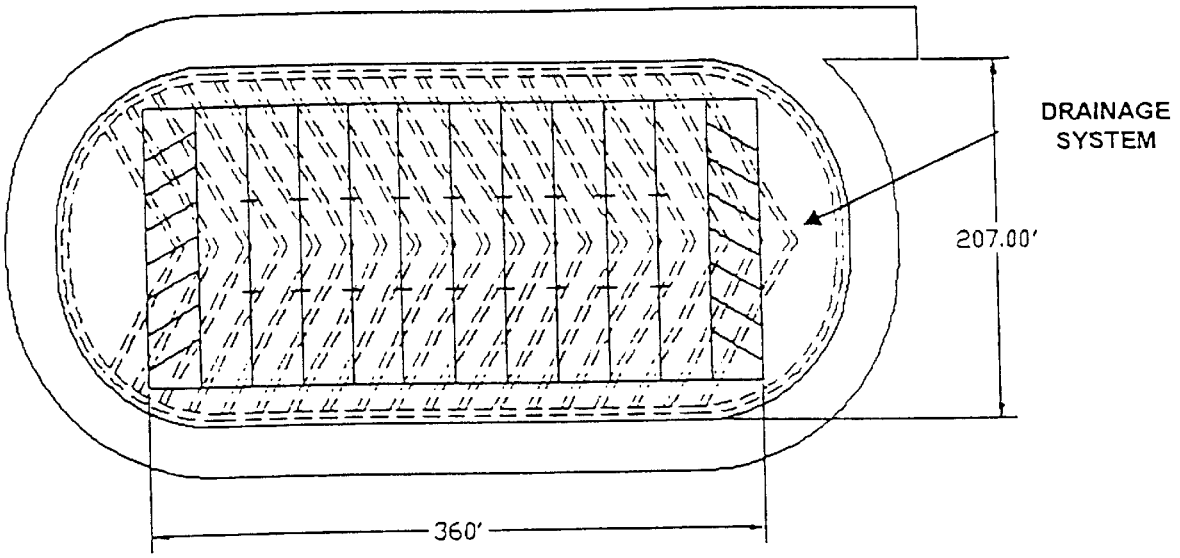
FIG. 2 is a schematic top view of a typical football field drainage system layout in accordance with the present invention.
Figure 3:
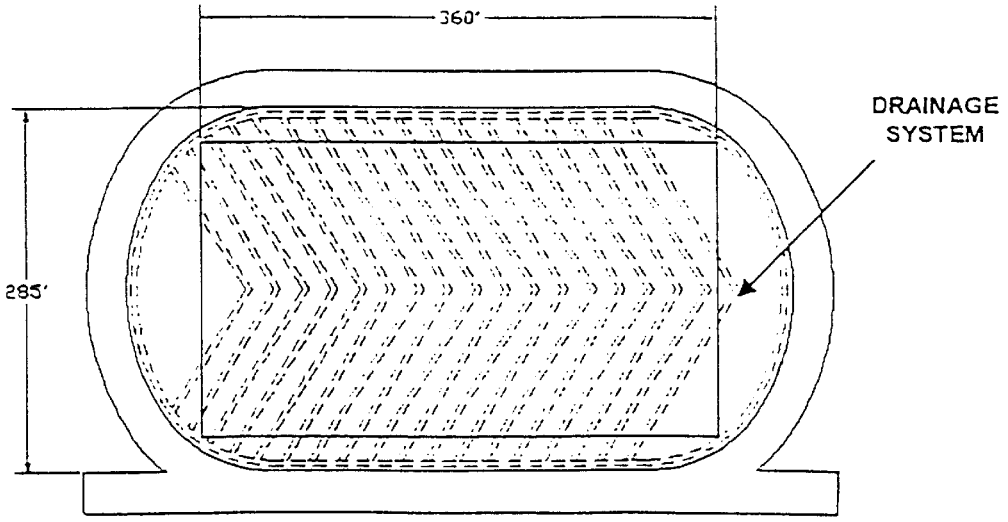
FIG. 3 is a schematic top view of a typical soccer field drainage system layout in accordance with the present invention.

An interior perimeter drainage system is used to assist in water drainage from the field, as illustrated in FIGS. 2 and 3. Preferably the system comprises a 1"×18" TRAX FLOW II prefabricated drain line 30 running along the interior edge of the track surface. The drain line 30 is a length of perforated, interconnected pipe and snap-on couplings and outlets made of high density polyethylene. A 3–4" wide trench is excavated such as with a rotary trencher to a sufficient depth to allow for the depth of the prefabricated drain plus an additional 2". The bottom of the trench should be consistent in elevation, with no deviation of more than 0.5 inches in ten feet. The drain line 30 is then placed in the trench and backfilled with fine aggregate 35 (e.g., concrete sand) meeting the following particle size specifications (ASTM C-33 fine aggregate standard):

25% coarse (2.0 mm to 5.0 mm)

50% medium (0.5 mm to 2.0 mm)

25% fine (0.025 mm to 0.5 mm)

No more than 5% of the total should be smaller than #200 sieve size. The sand backfill can be placed up to the surface or geotextile membrane. The remaining amount of open graded aggregate 5 is then installed over the underdrain system as shown in FIG. 1 and is compacted.

These lines 30 may be in communication with existing interior catch basins via appropriate connectors, although no catch basins need by used. An optional 1"×18" drain line may be installed approximately four feet inside the first line on each straightaway and connected to existing catch basins or by appropriate connectors to the common outflow pipe. 1"×6" underdrain lines are in communication with the inside drain lines and are arrayed in a typical herringbone design 5' to 30' on center, with 20' on center being the most preferable arrangement.

What is claimed is:

1. A synthetic turf comprising:

a sub-surface layer;

a porous aggregate layer over said sub-surface layer;

a pile fabric over said porous aggregate layer, said pile fabric comprising a plurality of pile elements tufted to a backing, said backing comprising a woven layer and a non-woven layer bound together; and an infill for said pile fabric, said infill consisting essentially of resilient particles.

2. The synthetic turf of claim 1, wherein said resilient particles comprise styrene-butadiene.

3. The synthetic turf of claim 2, wherein said resilient particles further comprise high density rubber.

4. The synthetic turf of claim 1, wherein said pile elements comprise polyethylene.

5. The synthetic turf of claim 1, wherein said backing further comprises a polymeric coating.

6. The synthetic turf of claim 1, wherein said non-woven layer is secured to said woven layer having a layer of felt thereon facing said non-woven layer.

7. The synthetic turf of claim 1, further comprising drainage means below said pile fabric for directing water away from said turf.

8. The synthetic turf of claim 7, wherein said drainage means comprises a plurality of perforated interconnected pipes.

9. The synthetic turf of claim 8, wherein said drainage means further comprises a plurality of holes in said backing.

10. The synthetic turf of claim 1, further comprising a geotextile membrane over said porous aggregate layer.

11. The synthetic turf of claim 10, further comprising a substantially non-compactable layer comprising sand and resilient material between said geotextile membrane and said pile fabric.

12. The synthetic turf of claim 11, wherein said resilient material in said substantially non-compactable layer is rubber embedded in said sand.

13. The synthetic turf of claim 1, further comprising a substantially non-compactable layer comprising sand and resilient material between said porous aggregate layer and said pile fabric.

14. The synthetic turf of claim 13, wherein said resilient material in said substantially non-compactable layer is rubber embedded in said sand.

15. A method of forming a synthetic turf on a sub-surface base, comprising:

forming a porous aggregate layer on said sub-surface base;

providing a pile fabric over said porous aggregate layer, said pile fabric comprising a plurality of pile elements tufted to a backing and an infill consisting essentially of resilient particles, said backing comprising a woven layer and a non-woven layer bound together.

16. The method of claim 15, further comprising providing water drainage by burying a plurality of perforated interconnected pipes below said pile fabric.

17. The method of claim 15, further comprising providing a geotextile membrane over said porous aggregate layer.

18. The method of claim 17, further comprising forming a substantially non-compactable layer comprising sand and resilient material over said geotextile membrane.

19. The method of claim 18, further comprising providing water drainage by burying a plurality of perforated interconnected pipes below said pile fabric.

20. The method of claim 15, further comprising forming a substantially non-compactable layer comprising sand and resilient material between said porous aggregate layer and said pile fabric.

21. A synthetic turf comprising:

a sub-surface layer;

a porous aggregate layer over said sub-surface layer;

a substantially non-compactable layer comprising sand and resilient material over said porous aggregate layer;

a pile fabric over said substantially non-compactable layer, said pile fabric comprising a plurality of pile elements secured to a backing; and an infill for said pile fabric, said infill consisting essentially of resilient particles.

22. The synthetic turf of claim 21, wherein said backing comprises a woven layer and a non-woven layer.

23. A synthetic turf comprising:

a sub-surface layer;

a porous aggregate layer over said sub-surface layer;

a geotextile membrane over said porous aggregate layer;

a substantially non-compactable layer comprising sand and resilient material over said geotextile membrane;

a pile fabric over said substantially non-compactable layer, said pile fabric comprising a plurality of pile elements secured to a backing; and an infill for said pile fabric, said infill consisting essentially of resilient particles.

* * * * *

US005976645C1

(12) EX PARTE REEXAMINATION CERTIFICATE (7217th)

United States Patent
Daluise et al.

(10) Number: US 5,976,645 C1
(45) Certificate Issued: Dec. 8, 2009

(54) VERTICALLY DRAINING, RUBBER-FILLED SYNTHETIC TURF AND METHOD OF MANUFACTURE

(75) Inventors: Daniel A. Daluise, Southboro, MA (US); Paul R. Lioi, Canton, OH (US)

(73) Assignee: Specialty Surfaces International, Inc., Wayne, PA (US)

Reexamination Request:
No. 90/008,339, Jan. 8, 2007
No. 90/010,105, Feb. 27, 2008

Reexamination Certificate for:

| | |
|---|---|
| Patent No.: | **5,976,645** |
| Issued: | **Nov. 2, 1999** |
| Appl. No.: | **09/088,797** |
| Filed: | **Jun. 1, 1998** |

(51) Int. Cl.
*E01C 13/08* (2006.01)

(52) U.S. Cl. ..... 428/17; 273/DIG. 13
(58) Field of Classification Search ..... None
See application file for complete search history.

(56) References Cited

U.S. PATENT DOCUMENTS

| | | | | |
|---|---|---|---|---|
| 3,605,666 | A | | 9/1971 | Kimmel et al. |
| 3,731,923 | A | | 5/1973 | Greene |
| 3,740,303 | A | | 6/1973 | Alderson et al. |
| 3,928,281 | A | * | 12/1975 | Uchigaki et al. ..... 524/425 |
| 4,053,668 | A | | 10/1977 | Kimmel et al. |
| 4,069,361 | A | | 1/1978 | Kumar |
| 4,337,283 | A | | 6/1982 | Haas, Jr. |
| 4,497,853 | A | | 2/1985 | Tomarin |
| 4,617,208 | A | | 10/1986 | Cadenhead, Sr. |
| 4,705,706 | A | | 11/1987 | Avery |
| 4,820,566 | A | | 4/1989 | Heine et al. |
| 5,836,716 | A | | 11/1998 | Johnson et al. |
| 5,962,101 | A | | 10/1999 | Irwin, Sr. et al. |
| 5,976,645 | A | | 11/1999 | Daluise et al. |
| 6,338,885 | B1 | | 1/2002 | Prevost |

OTHER PUBLICATIONS

ISO 9092:1988, Textiles—Nonwovens—Definition, International Organization for Standardization.*
Hoechst Celanese, Dictionary of Fiber & Textile Technology, 1990, pp. 8, 24, 71, 101, 120, and 137, Hoechst Celanese Corporation, Charlotte, NC.

* cited by examiner

*Primary Examiner*—Stephen J Stein

(57) ABSTRACT

Vertically draining synthetic turf having reduced abrasiveness and increased resilience compared to conventional synthetic turfs. The vertical draining system of the present invention prevents water from accumulating on the turf surface, which could cause the top-dressing layer to "float" and be moved by inundation. The draining system of the present invention incorporates a porous geotextile membrane between an open graded aggregate layer and a sand layer above the aggregate layer to prevent the movement of one aggregate layer into the other. The top-dressing layer consists of resilient particles, preferably a mixture of high and low density rubber. The pile fabric preferably includes an isotropic non-woven backing to add dimensional stability.

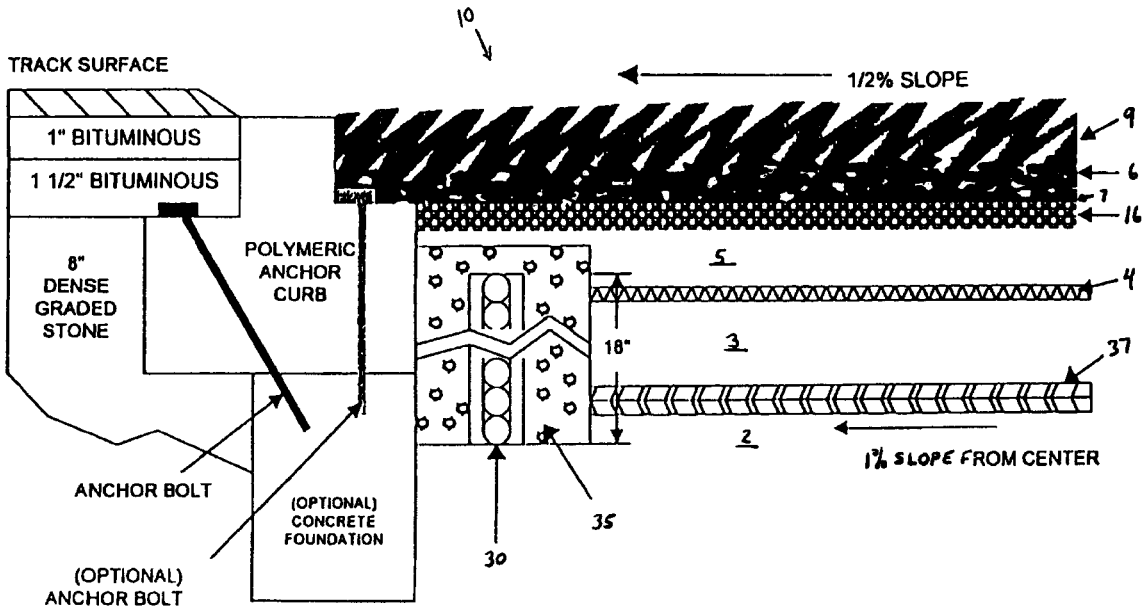

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 10, 15 and 17 are cancelled.

Claims 2, 4–7 and 16 are determined to be patentable as amended.

Claims 3, 8 and 9, dependent on an amended claim, are determined to be patentable.

New claims 24–29 are added and determined to be patentable.

Claims 11–14 and 18–23 were not reexamined.

2. The synthetic turf of claim [1] *26*, wherein said resilient particles comprise styrene-butadiene.

4. The synthetic turf of claim [1] *26*, wherein said pile elements comprise polyethylene.

5. The synthetic turf of claim [1] *26*, wherein said backing further comprises a polymeric coating.

6. The synthetic turf of claim [1] *26*, wherein said non-woven layer is secured to said woven layer having a layer of felt thereon facing said non-woven layer.

7. The synthetic turf of claim [1] *26*, further comprising drainage means below said pile fabric for directing water away from said turf.

16. The method of claim [15] *28*, further comprising providing water drainage by burying a plurality of perforated interconnected pipes below said pile fabric.

*24. A synthetic turf comprising:*

*a sub-surface layer;*

*a porous aggregate layer over said sub-surface layer;*

*a pile fabric over said porous aggregate layer, said pile fabric comprising a plurality of pile elements tufted to a backing, said backing comprising a woven layer, a non-woven layer tufted together with the woven layer and disposed between the woven layer and the porous aggregate layer, and a secondary layer liquid-applied to and absorbed by the non-woven layer on the side of the non-woven layer opposite the woven layer; and*

*an infill for said pile fabric, said infill being devoid of sand and consisting essentially of resilient particles.*

*25. The synthetic turf of claim 24, wherein the woven layer and the non-woven layer of the backing are tufted directly together.*

*26. A synthetic turf comprising:*

*a sub-surface layer;*

*a porous aggregate layer over said sub-surface layer;*

*a pile fabric over said porous aggregate layer, said pile fabric comprising a plurality of pile elements tufted to a backing, said backing comprising a woven layer and a non-woven layer bound together; and*

*an infill for said pile fabric, said infill being devoid of sand and consisting essentially of resilient particles.*

*27. The synthetic turf of claim 26, further comprising a geotextile membrane over said porous aggregate layer.*

*28. A method of forming a synthetic turf on a sub-surface base, comprising:*

*forming a porous aggregate layer on said sub-surface base;*

*providing a pile fabric over said porous aggregate layer, said pile fabric comprising a plurality of pile elements tufted to a backing and an infill being devoid of sand and consisting essentially of resilient particles, said backing comprising a woven layer and a non-woven layer bound together.*

*29. The method of claim 28, further comprising providing a geotextile membrane over said porous aggregate layer.*

* * * * *